US005670995A

United States Patent [19]

Kupcho et al.

[11] Patent Number: 5,670,995

[45] Date of Patent: Sep. 23, 1997

[54] APPARATUS FOR SIMULTANEOUS DOUBLE SIDED PRINTING

[76] Inventors: Kevin M. Kupcho, 15652 Williams St., Apt. 11K, Tustin, Calif. 92680; Marla K. Delano, 560 S. Revere St., Anaheim, Calif. 92805

[21] Appl. No.: 574,239

[22] Filed: Dec. 18, 1995

[51] Int. Cl.[6] ..... B41J 2/07

[52] U.S. Cl. ..... 347/5; 347/20; 347/104

[58] Field of Search ..... 347/20, 5, 42, 347/104, 40; 359/296, 498; 271/272

[56] References Cited

U.S. PATENT DOCUMENTS

| | | | |
|---|---|---|---|
| 4,207,578 | 6/1980 | Marinoff | 347/35 |
| 4,475,128 | 10/1984 | Koumura | 358/296 |
| 4,662,625 | 5/1987 | Hoyer | 271/272 |
| 4,932,798 | 6/1990 | Kardinal et al. | 400/120 |
| 5,101,224 | 3/1992 | Freed, Jr. | 347/4 |
| 5,144,328 | 9/1992 | Blake et al. | 347/101 |
| 5,265,867 | 11/1993 | Magee | 271/272 |
| 5,369,480 | 11/1994 | Isobe | 355/320 |
| 5,407,191 | 4/1995 | Ukai | 271/227 |
| 5,456,539 | 10/1995 | Wright et al. | 400/82 |
| 5,502,555 | 3/1996 | Lakatos | 355/311 |

FOREIGN PATENT DOCUMENTS

| | | | |
|---|---|---|---|
| 0518566 | 7/1993 | Japan | 347/42 |

*Primary Examiner*—Valerie Lund

*Attorney, Agent, or Firm*—Christie, Parker & Hale, LLP

[57] ABSTRACT

A dot matrix ink or bubble jet-type desktop printer is adapted to be connected to a personal computer by an RS-232 serial connector, and is able to simultaneously print on both sides of a sheet of paper. The double-sided printer includes a platen-less paper transport system which secures a sheet of paper to be printed in a substantially rigid plane with both sides of the paper exposed to printing. The paper transport system includes pick-up pinch roller assemblies arranged in contacting, opposed, counter rotating fashion, and tension roller assemblies, spaced-apart from the pinch roller assemblies which cooperate to define a substantially rigid plane between the sets of roller assemblies in which the paper is tensioned. Two print head carriage assemblies, each including a print head, are provided, in mirror-image relationship, on either side of the paper plane. Processor controlled electronic printer control circuitry includes parallel pipelined data paths for providing front and back page printer information to the separate print heads, so as to effectuate simultaneous printing on both sides of a piece of paper.

14 Claims, 6 Drawing Sheets

APPARATUS FOR SIMULTANEOUS DOUBLE SIDED PRINTING

FIELD OF THE INVENTION

The invention relates to bubble jet or ink jet-type printers adapted to be connected to a personal computer, and in particular, to an ink jet or bubble jet-type printer able to print on both sides of a page simultaneously.

BACKGROUND OF THE INVENTION

Because of the widespread acceptance of personal computer systems in business, industry, and general home use, an evolution has taken place in small, high speed, high resolution printer systems.

Impact printers are the oldest and, generally the simplest, of printers in which images are literally forced against a page, either as fully formed characters and symbols, or as a matrix of individual dots. These types of impact printers are referred to as character and dot-matrix impact (DMI) printers, respectively. Character printers, evolved from a form of automated typewriter, were developed in the early days of the computer industry to record data and program listings that were often too cumbersome to be written down by hand. As with the common typewriter, characters were pre-formed onto metal or molded plastic structures called dyes, which were positioned in front of a paper platen and whose characters were stamped onto the page. Impact was accomplished by striking the dye with a solenoid (commonly termed a hammer), thus impacting the paper through an inked ribbon.

Dot-matrix impact (DMI) printing also relies on a physical impact to produce an image on paper. Unlike a character printer, a DMI printer forms images as a series of individual dots each of which is generated by an individual print wire which is, in turn, driven through an energized solenoid. The solenoid forces its corresponding print wire against a page. After impacting the page, the print wire is free to return to its solenoid leaving behind an ink dot. DMI print heads commonly are constructed of an array of seven, nine, or twenty-four print wires arranged in vertical columns.

The technique of DMI printing is generally quite straightforward, however, the actual formation of each letter, number, or symbol is more complex than in character printing. Data received from a host computer is interpreted by a printer's logic circuitry and converted to a series of vertical dot patterns. Motor commands move the print head across the platen and, simultaneously, printer circuits provide each vertical dot pattern to the print head in series fashion. Each vertical dot pattern fires the corresponding print wires through an inked ribbon to leave a permanent mark on the page to be printed.

While impact-type printers remain a cornerstone of commercial printing technology, they are deficient in many important respects. Impact printers, by their very nature, are very noisy devices. The continuous drone of daisy-wheels, character-balls, or print wires striking paper can become quite annoying over time. In addition, character printers suffer from an inherent inflexibility in performance. The only characters that are able to be printed are those pre-provided on the dye set in use at the time. Different type styles or sizes may be substituted, but the printer must be stopped and an additional dye set installed. In addition, character printers are unable to support bit-mapped graphics.

Impact printers, while faster and more flexible than character printers, lack the resolution and electronic sophistication to produce letter-quality text printing and the fine resolutions required by modern graphics applications. In addition, all impact-type printers require a heavy platen, which supports the paper, and which also functions as an anvil, against which a character dye or a print wire is struck. This type of mechanical construction, i.e., a hammer and anvil with an interposed print ribbon, leads to inevitable mechanical wear with its consequent increased service cost and decreased usable lifetime.

A particular implication of using an impact-type print head in combination with a platen, is that it is not possible to print on both sides of a page simultaneously.

Other, more modern technologies have been developed in order to overcome some of the deficiencies of impact-type printers. Ink jet and bubble jet-type printers utilize a non-contact technology in which liquid ink is dispersed onto a page through individual ink nozzles contained within a print head. Depending on the particular print head design, ink jet or bubble jet print heads commonly comprise nine, twelve, twenty-four, or more individual ink nozzles, each of which can be fired independently so that the ink jet system is capable of producing high-quality characters and graphics.

In common with other serial-type print heads, ink jet or bubble jet heads form images one character line at a time, as the head sweeps back and forth across the page. In later developments of ink jet and bubble jet printer technology, the print head forms a partial image with each scan; the entire image is often formed by raster scanning two, three, and lately over ten line portions for a full character line.

Since ink or bubble jet printers utilize a noncontact print technology they have no requirement for a platen which functions as an impact anvil, as well as supports the paper. Conventional ink or bubble jet printers are constructed using print heads disposed on a carriage that moves the print head, linearly, in the x direction (left and right) across the page, as the page is indexed in the y direction under the carriage. Printing is accomplished by raster-scanning, in much the same fashion as an image is painted on a television screen.

The majority of the mechanical systems provided in an ink or bubble jet-type printer are used to feed and position a piece of paper to be printed, with respect to the print head carriage. Guide and controllers function to index the paper beneath the print head as the head scans to form a character. As well as indexing the page in response to a line feed control signal, the page is ejected in response to a form feed character. Typically, the paper is supported on a flat platen, which serves little function, other than to support the paper in an appropriate plane, perpendicular to the print heads ink jet stream.

Ink and bubble jet printer technology provides a method of non-contact printing that is able to be used on a wide variety of paper types and paper surfaces. Print speeds are on the order of 100 to 150 characters per second, with very quiet operation. Because ink nozzles can be constructed very small, dot resolutions on the order of from about 300 to about 600 dots per inch (dpi) can be realized. Non-contact print heads have no mechanical parts, so they are able to enjoy high reliability and a long working lifetime.

However, while high speed, ink and bubble jet printers remain unable to print on both sides of a page simultaneously. Modern computer systems incorporating data compression algorithms, and large scale memory, are able to process and transmit volumes of data to a printer, in amounts and at speeds beyond the capabilities of conventional printer devices to print in real time. For example, multiple pages of text or graphics information may be transmitted to a printer, and stored in the printer's internal memory, in the space of tenth's of seconds, while the printer itself requires at least ten seconds to paint one page's worth of information. If an ink or bubble jet printer were able to print both sides of a page simultaneously, it would literally cut in half the amount of time required to print a long, multi-page document, particularly if it includes graphic images.

Consequently, there is the need for a printer apparatus, that can be connected to a personal computer, that is able to print both text and graphic images on both sides of a page simultaneously. Such a printer would, of necessity be platen-less, and be able to print on a wide variety of paper sizes and thicknesses. In addition, such a printer should be compatible with currently available printer drivers, as well as being easily adapted to print in the double sided mode without complex or costly modifications of its electronic components or software drivers.

SUMMARY OF THE INVENTION

According to practice of principles of the invention, a dot matrix ink jet-type desktop printer adapted to be connected to a personal computer by an RS-232 serial connector, includes a platen-less paper transport system which secures a sheet of paper to be printed in a substantially rigid plane with both sides of the paper exposed to printing. The transport system includes a first pair of pick-up pinch roller assemblies arranged in contacting, opposed, counter rotating fashion, and a second pair of tension roller assemblies, spaced-apart from the pinch roller assemblies so as to define a substantially rigid plane between the first and second pairs of rollers in which the paper is disposed.

A first print head carriage assembly, including a first print head, is disposed on one side of the plane of the paper and a second print head carriage assembly, including a second print head, is disposed on the opposite side of the plane of the paper from the first print head carriage assembly in mirror-image relationship.

Processor controlled electronic printer control circuitry includes parallel pipelined data paths for providing front and back page printer information to the first and second print heads. The first and second print head carriage assemblies are independently operable in response to front and back page control signals provided by said control circuitry, and the first and second print heads are additionally independently operable in response to front and back page print data, so as to effectuate simultaneous printing on both sides of a piece of paper.

In one aspect of the invention the first and second print heads are ink jet-type print heads, while in another aspect of the invention the first and second print heads are bubble jet-type print heads.

In yet another aspect of the invention, the pinch roller assemblies and the tension roller assemblies each further include a plurality of friction surfaced rollers, the rollers of one half of each pair of assemblies in circumferential contact with the rollers of their respective opposite halves in counter-rotating fashion. The rollers comprising the tension roller assemblies have a larger diameter than the rollers of the pinch roller assemblies so that when a sheet of paper is advanced between them, the sheet is tensioned and supported in a substantially rigid plane, exposed to the first and second print heads, that allows platen-less double-sided printing.

BRIEF DESCRIPTION OF THE DRAWINGS

These and other features, aspects and advantages of the present invention will be more fully understood when considered with respect to the following detailed description, appended claims and drawings, wherein:

DETAILED DESCRIPTION OF THE PREFERRED EMBODIMENTS(S)

Figure 1:
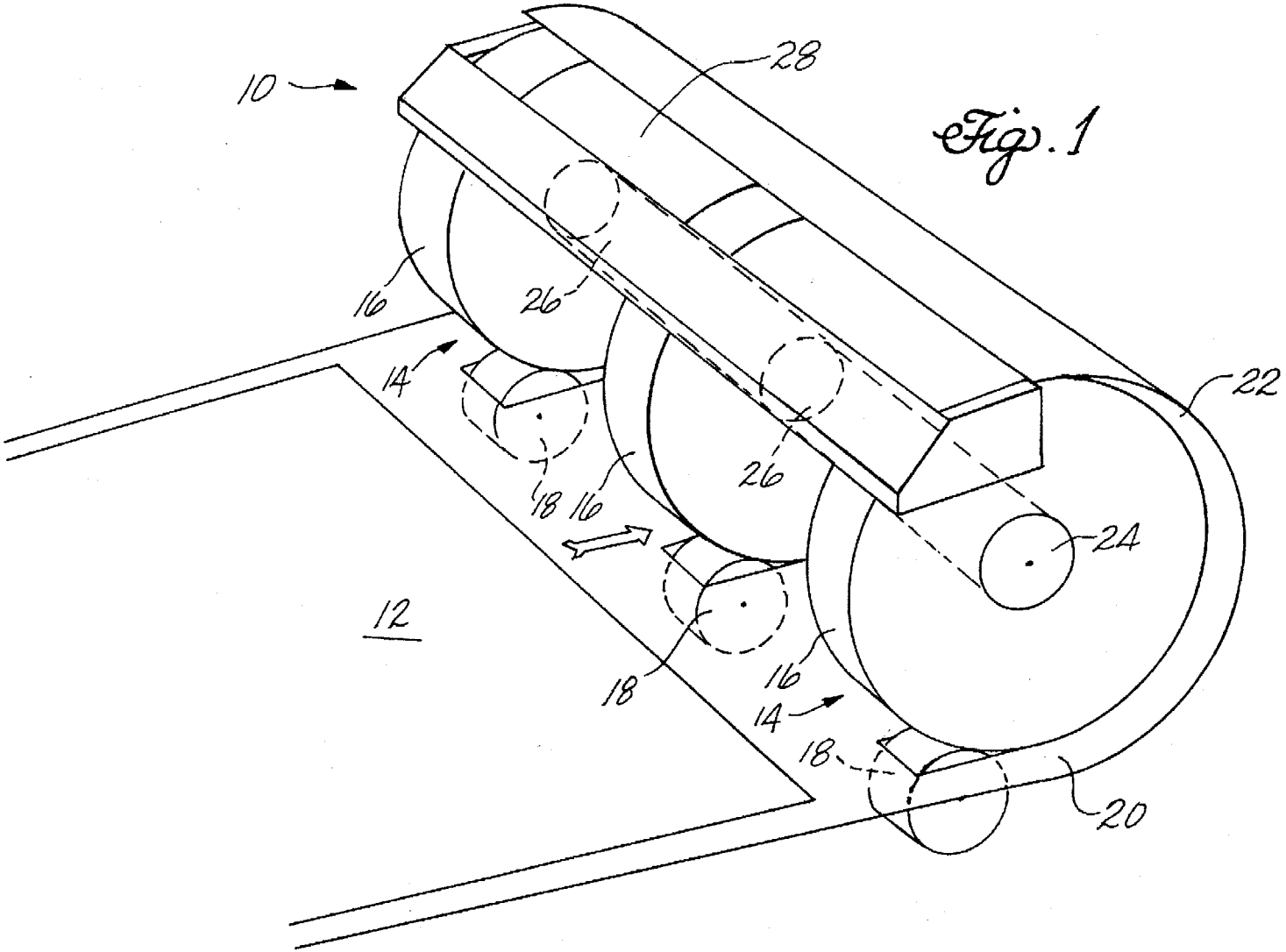
FIG. 1. is a simplified perspective view of the mechanical paper transport elements of an ink jet printer in accordance with the prior art.

Referring now to FIG. 1, there is depicted a simplified, partial perspective view of the interior construction details of a prior art ink jet dot matrix (IDM) type printer, of the type commonly adapted for connection to a personal computer. The prior art printer is referenced for comparison purposes, and is exemplified by the design and construction of a DeskJet Ink Jet printer Model No. 5xx–6xx, manufactured and sold by Hewlett-Packard Corporation, of Palo Alto, Calif.

Ink jet printers (or alternatively, bubble jet printers) consist, primarily, of three major mechanical systems; a paper transport system, a print head assembly, and a print head carriage assembly. With respect to the prior art ink jet printer depicted in FIG. 1, the paper transport system 10 is a classical friction feed type, wherein a sheet of paper 12 is guided into a receiving receptacle 14 and from whence it is moved into a position so that it may be engaged by friction feed rollers 16. The friction feed rollers 16 are lightly biased against bearing, or bale rollers 18 provided in the bottom of the receiving receptacle or cavity, such that when the leading edge of a sheet of paper is inserted therebetween, the matte rubber surface of the friction feed rollers grabs the surface of the paper and propels the sheet in the direction of rotation of the roller.

As seen in FIG. 1, the receiving receptacle or cavity 14, extends into a guide cavity 20 which is generally semicircular in cross-section, and also functions as a travel guide for the leading edge of the paper sheet. As the paper is being moved along by the propelling action of the friction rollers, the leading edge of the sheet contacts the interior surface of the guide cavity 20 and follows its contour until the leading edge of the paper is advanced into a feed guide 22. The feed guide 22 ensures that the paper sheet is positioned and maneuvered properly such that the paper leading edge is inserted between the friction rollers and the free-rolling bale rollers 18 which press gently against the paper to assist in maintaining contact between the paper and the friction rollers.

Paper may be manually inserted into a printer of this type, by sliding a sheet of paper into the guide receptacle, and rotating the friction rollers by turning a knob 24 connected to a shaft 26 which is inserted through the axial centers of the friction rollers, much in the same fashion as paper is loaded into a manual or electric typewriter. Alternatively, paper may be automatically loaded into such a printer, by issuing a load command, from an attached personal computer for example, the load command causing electronics in the printer to operate a motor which causes the friction rollers to revolve.

When automatic loading is used, the friction rollers revolve continuously until the paper sheet leading edge is guided into its initial position, where it activates a sensor, which in response, commands the printer electronics to stop rotating the friction roller motor. Once paper is loaded, the paper transport system functions to maintain the paper in proper alignment to the print head, and, in addition, supports the paper in the region immediately below the print head in order to maintain the paper surface in an appropriate plane for high resolution printing.

An alignment shelf 28, typically constructed of a light metal or rigid plastic, provides support for the paper in the region beyond the end of the feed guide. Paper is pushed over the surface of the support, which supports the paper in a flat plane, the upper surface of which is exposed to the print head for printing. Motion of the paper through the paper transport system during the printing process, is once again controlled by electronic control signals received from a computer system to which the printer is attached. In well known fashion, the friction rollers are caused to rotate by a fixed amount (commonly termed indexing), upon receipt of a line feed control character, or, alternatively, upon receipt of an end-scan control character, both of which indicate that the print head has completed printing or scanning that particular line of text or graphics. The friction rollers are rotated, causing the paper to advance to present the next spatial region to be printed through the print head. Once printing is completed, a carriage feed, or hard page control signal causes the printer electronics to rotate the friction rollers and eject the paper from the paper transport system.

Text and graphic images are generally formed on the paper by scanning a print head back and forth across the paper sheet surface. As the print head scans, it paints a series of vertical dots that combine to create the desired image. Accordingly, the print head must move at the appropriate time, at the proper speed, and across the proper distance, to within several thousandths of an inch on every pass, in order to accommodate high definition printing.

Figure 2:
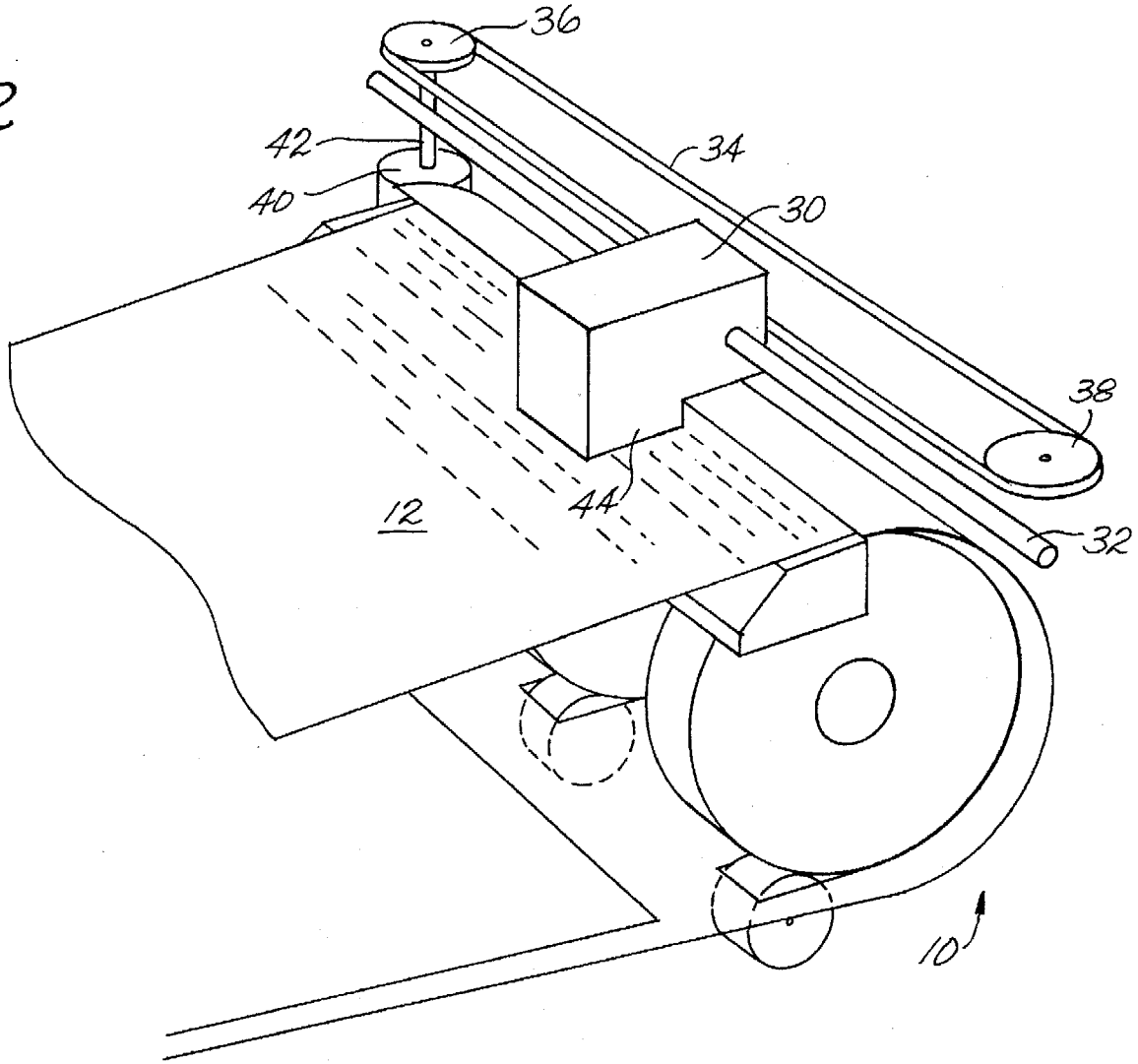
FIG. 2. is a simplified semi-perspective, partial cross-sectional view of the mechanical carriage transport elements of an ink jet printer in accordance with the prior art.

In FIG. 2, a simplified carriage transport system for supporting, aligning, and scanning a print head is depicted. A print head assembly 30 is connected to a low friction rail 32 which is, in turn, suspended over the paper transport system 10, and along which the print head is driven when it is scanned over the paper surface. A continuous loop drive belt 34 is attached to the back of the print head assembly and forms a continuous loop around a primary pulley 36 and a secondary pulley 38 which are disposed at opposite ends of the low friction rail. A print head carriage motor 40 is attached to the primary pulley by means of a drive shaft 42 and is operable to cause the primary pulley 36 to revolve, thus causing the drive belt 34 to move the print head assembly 30 along the carriage rail 32. Carriage motors of this type are typically three-phase, uncommutated, DC, high torque electric stepper motors which are able to rotate the primary pulley, at high speed, in either direction in response to control signals provided by printer control electronics. The secondary pulley 38 is provided as a return path for the drive belt and in addition may be connected, in spring loaded fashion to the printer housing in order to provide tension for the belt.

Non contact printing is accomplished by dispersing liquid ink onto a paper sheet 12 through individual ink nozzles provided in, for example, an ink jet or bubble jet-type print head 44. Depending on the particular print head design, ink may be located in a separate reservoir disposed in the printer housing and away from the print head, or alternatively ink may be stored in a reservoir integrated into the print head assembly. Each ink nozzle may be activated independently and is independently connected to the ink reservoir.

Ink jet print heads form images one character line at a time, as the print head is scanned back and forth across the paper sheet. Character information is received from a host computer, and converted by the printer electronics into a series of vertical dot patterns recalled from the printer's permanent memory. Each dot pattern is provided, in turn, to the print head over a multi-conductor, flat, ribbon cable, connected between the print head and the computer electronic circuit board. The printer's driver circuits amplify and condition the signals provided by the printer's main logic, into high-energy pulses suitable for use to activate each ink nozzle which sprays a small jet, or in the case of a bubble-type a small bubble, of ink onto the paper surface.

Returning now to FIG. 1, it should be apparent that in the ink or bubble jet-type printer according to the prior art, it is not possible to effectuate printing on both sides of a paper sheet simultaneously. Double sided printing requires the laborious process of completing printing on one side of the page, removing the paper from the out-tray, turning it over, and reinserting it in the in-tray. Conventional printing must be performed on both sides of the page in sequential fashion. This result necessarily obtains because prior art ink jet printer systems only provide a single print head, which is necessarily only capable of printing on a single side of a page.

Figure 3:
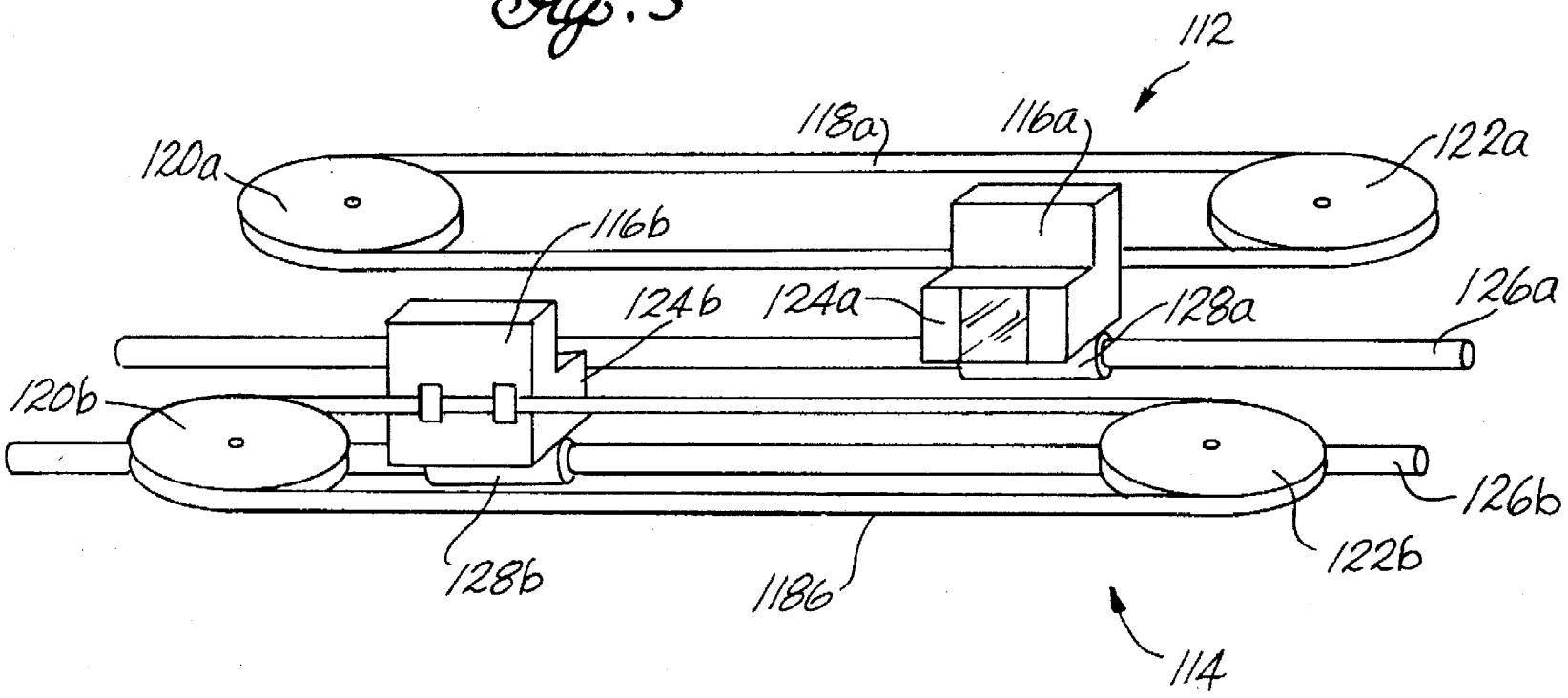
FIG. 3. is a simplified semi-perspective, partial cross-sectional view of the mechanical print head carriage elements of an ink jet printer in accordance with practice of principles of the invention.

Turning now to FIG. 3, there is depicted a simplified, partial perspective view of carriage elements suitable for simultaneous double-sided printing in accordance with practice of principles of the invention.

In FIG. 3, the double-sided printer carriage elements, generally indicated at 110, suitably comprises first and second print head and carriage assemblies 112 and 114, disposed in mirror image relationship to one another. For purposes of clarity, and ease of identification, reference numerals indicating structure or elements on the first print head and carriage assembly 112 will be followed by the letter "a", while the corresponding structure or elements of the second print head and carriage assembly 114, will be followed by the letter "b". Each of the two print head and carriage assemblies includes a print head assembly (**116*a* and 116*b*) each attached to a drive belt 118*a* and 118*b* constructed in a continuous loop fashion. Each of the drive belts 118*a* and 118*b* engages the circumference of a corresponding carriage assembly belt drive pulley 120*a* and 120*b*, which, when rotated by a drive motor, moves the corresponding drive belt and, thus, the attached and corresponding print head in a back and forth motion. Supply, or tension pulleys 122*a* and 122*b* are provided at the opposite end of the looped drive belts in order to properly tension the belts and provide a return path for each belt's continuous loop. Thus, it can be seen that each print head 116*a* and 116*b* is movable, in a back and forth (or scan) direction along the drive belt, between end points defined by, on the one hand the carriage assembly drive pulleys 120*a* and 120*b*, and the supply or tension pulleys 122*a* and 122*b* on the other. The two sets of pulleys are disposed a sufficient distance apart so that the print heads 116*a* and 116*b*** each have a linear travel distance at least as large as the width of a standard size sheet of paper. Preferably, the drive pulleys and tension pulleys are spaced-apart by about ten inches, and are preferably on the order of about ¾ of an inch in diameter.

The drive belts 118*a* and 118*b* and pulley drive system may be one of various well known types currently used in the art, such as a friction engaged elastomeric rubber type belt, or preferably a flexible elastomeric plastic belt constructed with periodically spaced-apart interior cog teeth, each adapted to engage equally spaced-apart mating indentations provided on the periphery of the drive pulley. Alternatively, those skilled in the art will immediately recognize that belt and pulley drive systems may be easily substituted with, for example, a worm-gear drive mechanism or other similar, well known drive systems.

Returning now to FIG. 3, each of the print heads 116*a* and 116*b* is arranged such that their printing surfaces 124*a* and 124*b* are aligned parallel to a central plane that medially bisects the double sided printer apparatus and which defines the plane of the paper on which double sided printing is desired. Each printing surface further includes a multiplicity of ink jet (or bubble jet) ink nozzles, by means of which print information is transferred to the paper. Each of the printing surfaces 124*a* and 124*b* and, thus, the ink nozzles, face one another and, when a sheet of paper is interposed between them, each printing surface is capable of independently printing on the side of the page which faces it.

Carriage assembly guide rails 126*a* and 126*b* provide support for their respective print heads 116*a* and 116*b*, which are each affixed to their erspective guide rails by a smooth bushing 128*a* and 128*b*, which allows each print head to slide back and forth along its respective guide rail with little to no friction induced rubbing, or stuttering. In addition to providing a burnished support surface along which the print head may slide, the guide rails additionally function to position each print head in the vertical direction and to align each print head with respect to the plane of the paper. Once the plane of the paper has been defined, and the dimensions of the print head have been determined, the placement of the carriage assembly guide rails 126*a* and 126*b* is simply the matter of mathematical calculation from the predetermined mechanical design parameters.

Figure 4:
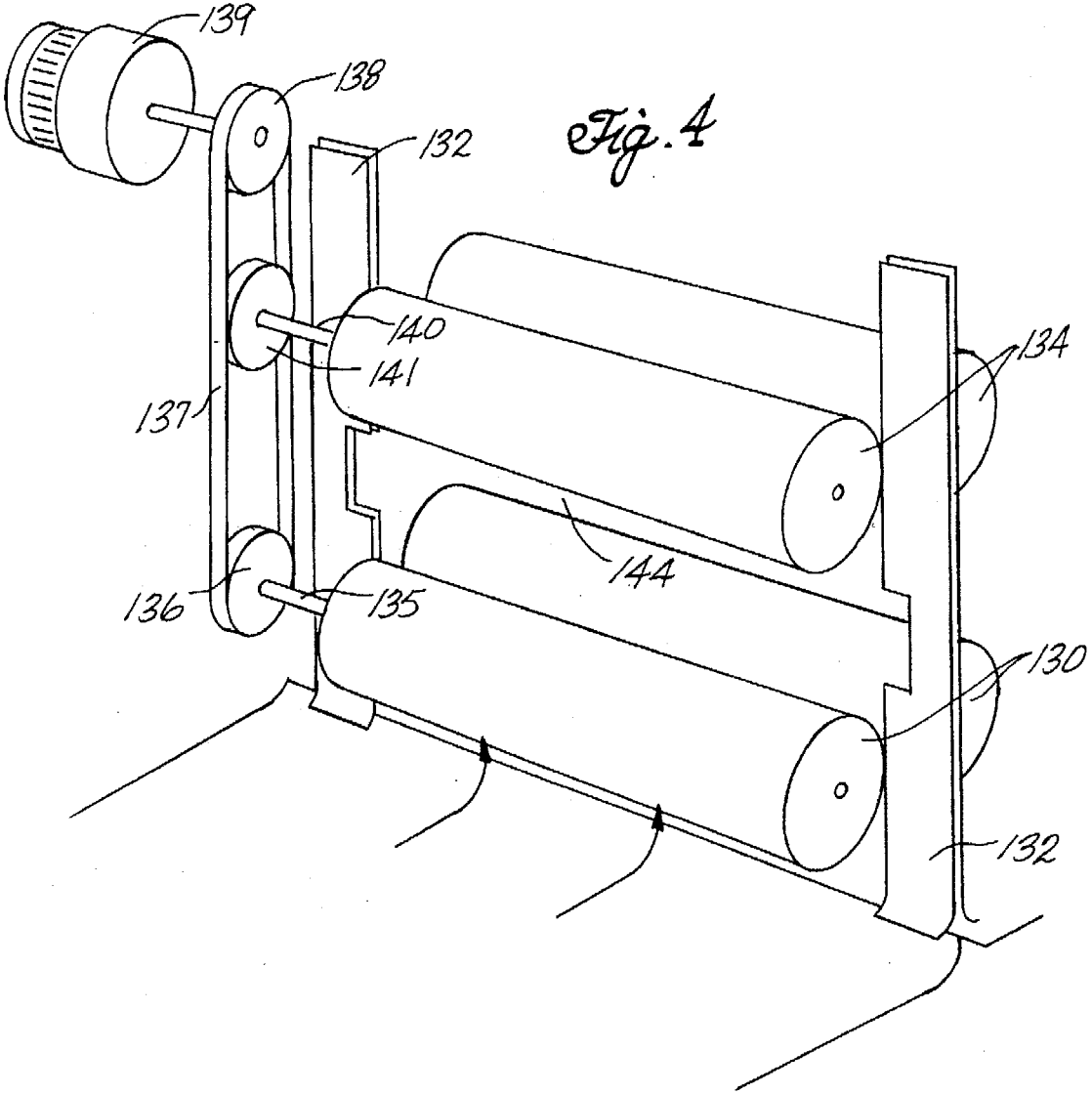
FIG. 4. is a simplified, partial perspective view of the paper transport portions of an ink jet printer in accordance with the invention.

Turning now to FIG. 4, there is depicted a simplified, cross-sectional view of the paper transport portion of the double sided printing apparatus in accordance with the practice of the principles of the invention. Paper is fed into the apparatus by means of means of a paper tray, paper slot, or other suitable and well known paper introduction methods. As each sheet is introduced into the double sided printer, its leading edge is inserted between a pair of opposed pick-up pinch roller assemblies 130 which grab the paper leading edge between them, and advance the paper into paper guides 132. The pick-up pinch roller assemblies generally comprise a solid friction (or matte) surfaced roller, rotatably disposed about a axial central shaft 135, which spans across the entire apparatus and is at least as wide as the width of a piece of paper to be printed. Alternatively, a multiplicity of generally disk-shaped, friction (or matte) surfaced rollers may be provided in a manner similar to the paper transport system of the prior art.

The pinch roller shaft 135 terminates in, and is driven by, a pully 136, connected, in turn, by a drive belt 137 to a drive pully 138. The drive pully 138 is rotatably driven by a paper transport stepper motor 139 in conventional fashion, in response to load, line feed and/or page feed signals developed by the printer electronics and provided to the motor 139.

After being picked up by the pinch roller assemblies 130, the left and right hand edges of a sheet of paper are advanced thereby and guided through a set of paper guides 132, disposed on either side of the paper feed mechanism. The paper guides 132 serve to align the left and right hand edges of the paper and provide a path along which the paper is advanced by the pinch rollers 130. As the paper moves along the paper guides 132, the paper is moved into position where its leading edge is engaged by a second set of pinch rollers 134, constructed in the same fashion as the pick-up rollers 130, and including a central shaft 140 terminating in a drive pully 141 which is commonly connected to and driven by the same drive motor 139, through drive belt 137, which drives the pick-up pinch rollers 130. The second pinch roller set (the pull rollers 134), are constructed with an outer diameter approximately 2 to 7% larger, preferably 3%, than the outer diameter of the pick-up pinch rollers 130. When paper is engaged between the two sets of rollers, the larger diameter pull rollers 134, which are being rotated at the same speed as the pick-up rollers 130 by the drive motor 139, tend to pull the paper taught between the pull rollers 134 and the pick-up rollers 130, thus providing a proper tension to the paper sheet. Tensioning the paper in this manner functions to align and secure the paper in a plane 144 between the two sets of rollers without the need for a supporting member such as a platen. In this instance, no additional structure is required in order to maintain the paper in a flat plane for efficient printing, the paper being maintained in a generally rigid and flat condition by being in effect suspended in space between the two roller sets 130 and 134.

The portion of the paper suspended between the two roller sets is accessible to the first and second print heads (116*a* and *b* of FIG. 3), which are arranged on the front and back side of the paper sheet respectively. Each print head is mounted on its carriage assembly guide rails (126*a* and *b* of FIG. 3), respectively, which are arranged to support their respective print heads adjacent the exposed taught or tensioned plane 144 of the paper sheet. Each print head includes a multiplicity of ink jet nozzles, on a face perpendicular to the paper sheet and also includes an internal ink reservoir, connected to the ink jet (or bubble jet) nozzles. Each print head may be a unitary print head, permanently affixed to the carriage assembly guide rails, or alternatively, the print head may be constructed as a light thermoplastic shell, connected to the carriage assembly rails, and including a snap-end receptacle for receiving a disposable print head/cartridge combination, such as a Hewlett-Packard HP 51649A print cartridge, manufactured by Hewlett-Packard Corporation of Palo Alto, Calif.

Both the front and back carriage assembly guide rails (126*a* and *b* of FIG. 3), respectively, are disposed in the same horizontal plane, so that both the front and rear print heads can be scanned along the same horizontal line; one on the front and one on the back of the plane of the paper sheet.

Figure 5:
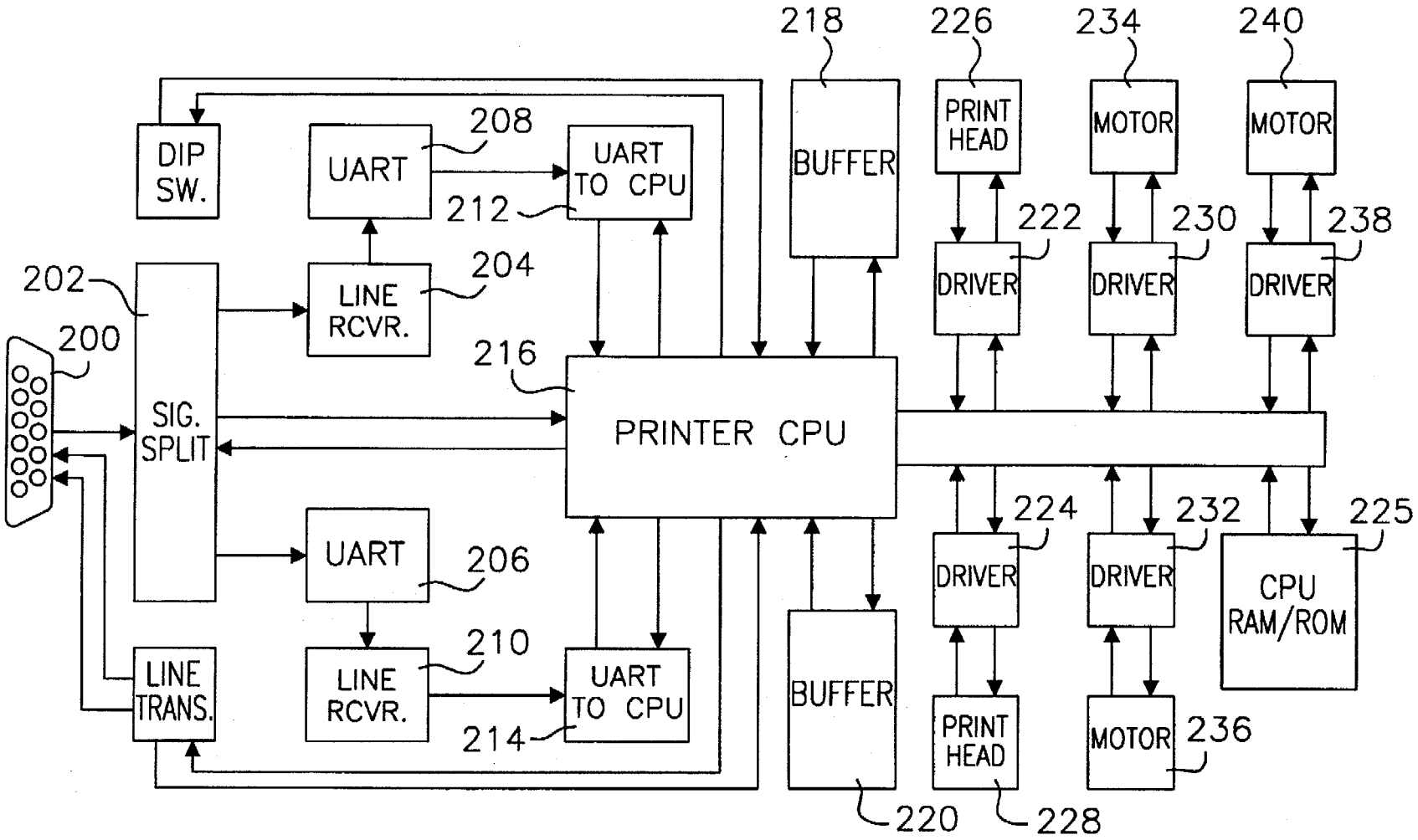
FIG. 5. is a simplified block diagram of electronic printer control circuitry in accordance with the invention.

Electronic control circuitry which handles the transfer of data between the printer and an attached computer system, and provides electronic control signals for controlling various printer functions, is depicted, in block diagram form, in FIG. 5.

Data and control characters are communicated between the printer and an attached computer system via an RS 232-type serial interface protocol, over a standard RS 232 connection 200. When a computer system's application is directed to print by an operator, information is directed to the printer over the serial interface 200, to the printer electronics. In the exemplary embodiment of FIG. 5, where data is being sent to the printer system for printing, the data is transmitted over the transmit data signal line Tx, of the serial interface, and directed to a signal splitter circuit 202, which determines whether the data being sent to the printer is to be printed on the front side of the page or the back side, and accordingly whether the incoming data pertains to the front print head or the back print head. As will be described in greater detail below, the signal splitter circuit 202 directs the data to either front page line receivers 204 or back page line receivers 206 which comprise circuitry adapted to convert the data signal from standard bipolar RS 232 signal levels to TTL or CMOS signal levels, compatible with the remaining electronic control circuitry.

Once converted to the appropriate signal level, the data received from the computer system is directed by the line receivers 204 and 206, to either front or back page universal asynchronous receiver transmitter circuits (UART) 208 and 210 respectively. UART circuits 208 and 210 perform data conversion on the incoming signals and are adapted to attach or remove, depending on whether data is being transmitted or received, overhead bits of the serial data stream, such as start bits, stop bits, and a parity bit, in accordance with well known principles. A wide variety of UART circuits are available for implementation into the electronic circuitry of the double sided printer, such as an 80C250, if implemented in CMOS circuitry, or a 74LS250, if implemented in Schottky TTL circuitry.

After data conversion, and overhead-bit striping, the asynchronous serial data stream is synchronized by the front page or back page UART to CPU interface circuits 212 and 214, respectively. The interface circuits 212 and 214 synchronize the serial data stream to a CPU clock signal provided by the printer CPU 216 to each of the interface circuits 212 and 214. After the serial data stream is synchronized to the internal clock cycles of the printer CPU 216, data is directed to the CPU from the interface circuits, wherein the data stream is processed, in accordance with well known principles, to determine whether the data comprises character or graphic information to be printed, or a control character which functions to manipulate and control the mechanical systems of the double sided printer.

Front and back page memory buffer circuits 218 and 220, respectively, are connected to the printer CPU 216 to receive and store front and back page data. The serial data, provided by the computer system, is acquired and temporarily stored in the buffer memory 218 and 220 until required by the CPU. The buffer memory circuits are large scale memories with storage capacities of from about 256 kilobytes, up to about 4 to 8 megabytes. The buffer memory circuits are, thus, capable of storing sufficient information to comprise several pages of information to be printed on the front or back side of a paper sheet. The buffer memory circuits 218 and 220 are filled and accessed in accordance with well established handshake protocols, which allow the efficient use of the computer system's computational resources. By providing for buffer memory, the double sided printer apparatus is able to receive and store bursts of serial data, inform the host computer system that the buffer memory is full and, therefore, not to provide any additional print information, and to print the information contained in the buffer memories, in background, while the host computer system attends to other tasks.

As information is removed from the buffer memories by the printer CPU, the memory content in each of the buffer memory circuits 218 and 220, is reduced until a memory content flag is set, in well known fashion, thus informing the CPU that additional print information is required from the host computer system. The printer CPU, in response, issues the appropriate Data Set Ready/Data Terminal Ready (DSR/DTR) signals to the host computer system, informing the host computer that the printer is ready to receive additional print information. The additional information is again stored in the buffer memory circuits 218 and 220, until such time as the printer CPU 216 determines that sufficient information has been stored to warrant its transfer to a paper sheet.

Text character and graphic information, extracted from the buffer memory circuits 218 and 220 are processed by the printer CPU 216 into electrical signals that are directed to, and control front and rear print head drivers 222 and 224 respectively. Typically, character text information is provided in the form of ASCII control signals, which are converted into multi-bit digital control signals in accordance with a conversion algorithm, provided as a portion of the printer CPU's operational firm ware. An external CPU ROM/RAM 225 comprises the information on the operational parameters of the mechanical systems of the printer, and, in addition, may be programmed to receive downloadable fonts and various graphics recognition and conversion routines, to allow, for example, post script printing.

Front and back page print drivers 222 and 224, respectively, convert the digital information defining a serial dot sequence comprising a print character, into electrical pulses which activate the individual ink jet nozzles comprising the front and rear print heads 226 and 228 respectively.

The printer CPU 216 also controls the motion of the print heads 226 and 228 across the paper sheet by providing motion control signals to front and back carriage assembly driver circuits 230 and 232, respectively, which, in turn, provide electrical control signals which operate front and rear carriage assembly drive motors 234 and 236. Line feed and form feed control signals are detected by the printer CPU 216 and directed to a paper transport driver circuit 238 which, in turn, controls the paper transport drive motor 240.

Determining whether character information to be printed is front or back page character information is the function of a user-loadable software program controlled printer drive which is accessed by a computer applications program in accordance with well understood principles. Software driver programs may be easily configured by persons having skill in the art to access a print file and determine the page arrangement of data contained therein by evaluating the location of alternating page break control signals. Modern printer drivers are fully capable of multiplexing the data contained within the print file into alternating front and back page serial data streams. The composite serial data stream is, thus, comprised of alternating strings of binary signals (or bits) with each string having a predetermined fixed length.

Figure 6:
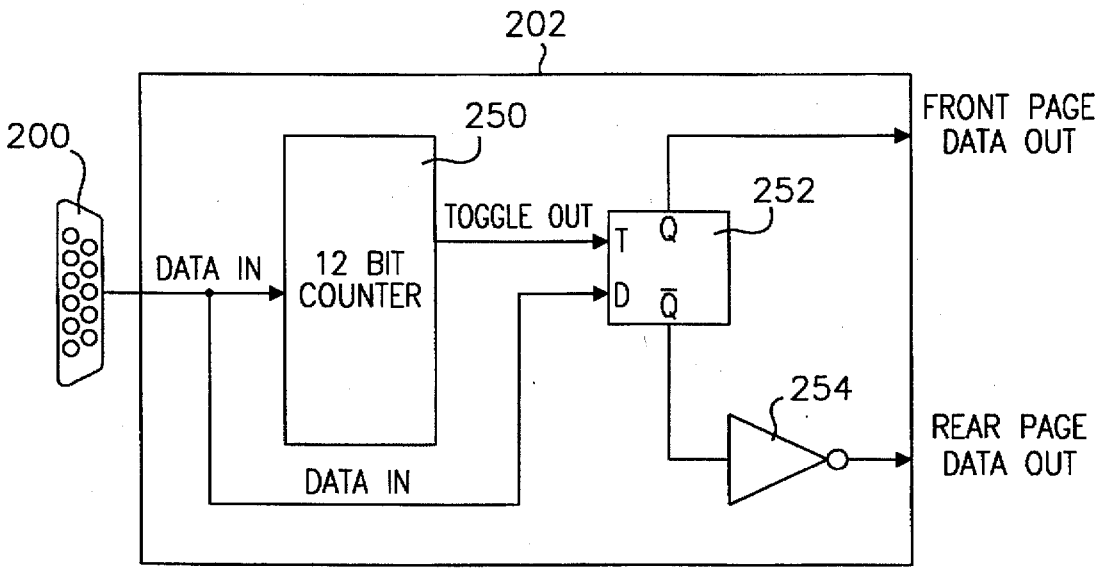
FIG. 6. is a simplified block diagram of a serial data stream signal splitter in accordance with the invention.
Figure 7:
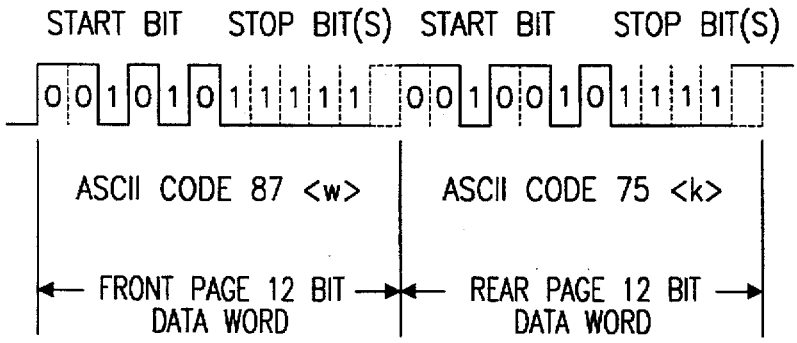
FIG. 7. depicts a binary serial data stream comprising front and back page printer data words in accordance with the invention.

Referring now to FIGS. 6 and 7, FIG. 7 depicts an alternating serial data stream, wherein each front and back page data word comprises 12 binary data bits. In the exemplary embodiment of FIG. 7, a 12 bit data word has been chosen as an arbitrary data word length, so as to comprise a single ASCII character code in combination with a start bit, a stop bit and a parity bit. The first 12 bits, comprising the front page data word includes the ASCII character code 87, representing the text character W as a binary bit string 01010111, preceded by a start bit, followed by a stop bit and an optional parity bit. The following 12 bits, the back page data word, are the binary representation 01001011, of the ASCII character code 75, which represents the letter k. Alternating front and back page characters are multiplexed into the composite bit stream by the software controlled print driver, or alternatively alternating lines of text, separated by a line feed or similar control character, may be multiplexed into a composite bit stream by the print driver.

It will be understood by those having skill in the art, that other methods of multiplexing front and back page print information may be implemented as well. Given the large amount of readable and writable memory available to modern computer systems, alternating pages of information may be output to a printer by the printer driver, in conventional fashion. In this case, the printer CPU could be easily programmed, by one having skill in the art, to control receipt of serial printer information, and store alternating pages of information in the front and back page buffer memories, until two full pages of text information, represented by two sequential form feed control characters, are detected by the printer CPU. At this time, the printer CPU issues a busy signal to the host computer system, indicating to the host computer that the printer electronics are unable to receive any further data, and begins alternate page printing. When printing is complete on one paper sheet, two additional pages of information are requested from the host computer system, and stored in the front and back page buffer memory circuits in preparation for printing the next paper sheet.

Returning to FIGS. 6 and 7, alternating 12 bit data word streams are received by the front/back page signal splitter circuit 202 wherein the signal stream is split and directed to the inputs of a 12 bit counter 250 and a T flip-flop 252. The 12 bit counter 250 counts the bits of the serial data stream and at every 12th bit, changes the state of an output line which is connected to the toggle input of the T flip-flop 252. In well known fashion, as the T input is toggled, the data, appearing at the D input is latched to either the Q or the $\overline{Q}$ outputs of the flip-flop 252.

In the exemplary embodiment of the signal splitter 202 of FIG. 6, the first 12 bits, counted out by the 12 bit counter 250, appear at the Q output of the flip-flop 252 and define the front page data, which is directed to the front page printer processing circuitry of FIG. 5. Likewise, the next 12 bits, defined by the toggle output of the 12 bit counter 250, appear at the $\overline{Q}$ output of the flip-flop 252. Since the $\overline{Q}$ output is an inverting output, an inverting buffer 254 is connected to the $\overline{Q}$ output, in order to reestablish the digital data stream to its original binary state. The output of the inverting buffer 254, thus, defines the back page data which is subsequently directed to the back page processing circuitry of the printer.

The process continues, with the printer driver software multiplexing alternate page data into a serial data stream, comprising alternate page data words, and the front to back page signal splitter, in effect, demultiplexing the serial information and directing front and back page data to its corresponding processing circuitry and buffer memory circuits. This parallel pipeline architecture, for front and back page data, continues throughout the printer system, such that independently controllable front and back page print heads receive the appropriate front and back page character and/or graphics information, so as to effectuate double sided simultaneous printing. Line and form feed control characters are used by the printer CPU to determine when each print head has completed printing its line of text and/or graphics information. If one print head completes printing its line of information before the second print head, the printer CPU waits until it detects a line feed control character directed to the second print head, before it issues a line feed command to advance the paper. Likewise, when in the double sided printing mode, the printer's CPU does not issue a form feed control signal to eject the paper, unless and until it detects a first, and subsequently second form feed control character, indicating that both the first (front) and second (back) print heads have completed a full page of printing.

An exemplary apparatus and system for simultaneous double sided printing on a single sheet of paper has been described with respect to the exemplary embodiments set forth herein. Thus, there has been brought to the art of full ink small desktop printers an improved system wherein both sides of a paper sheet may be printed without mechanical manipulation of the paper by an operator. Although described with respect to an ink jet-type printer, it will be immediately understood by those skilled in the art that the system and the method of the present invention is easily adaptable to a bubble jet-type printer without departing from the scope of the invention. The paper transport and print head carriage assemblies are similar, if not the same, in both printer types, as are the functional blocks of the printer control electronic circuitry. The print head driver circuitry would require minor modification, well within the understanding of one having ordinary skill, to adapt the print head driver signals to control the thermally heated dispersing nozzle actuation apparatus of a bubble jet-type print head.

Accordingly, it is to be understood that the method and system according to principles of this invention may be embodied other than as specifically described herein. The scope of the invention is defined only by the scope of the appended claims.

What is claimed is:

1. A dot matrix ink jet-type desktop printer adapted to be connected to a personal computer over an RS232 serial connector, the improvement comprising:

(a) a platen-less paper transport system, further including a first pair of pick-up pinch roller assemblies arranged in contacting, opposed, counter rotating fashion, and a second pair of tension roller assemblies, spaced-apart from the pinch roller assemblies, the paper transport system securing a sheet of paper to be printed in a substantially rigid plane between the first and second pairs of rollers;

(b) a first print head carriage assembly disposed to one side of the plane of the paper, the first print head carriage assembly including a first print head;

(c) a second print head carriage assembly disposed in mirror-image fashion on the opposite side of the plane of the paper from the first print head carriage assembly, the second print head carriage assembly including a second print head;

(d) processor controlled electronic printer control circuitry including parallel pipelined data paths for providing front and back page printer information to said first and second print heads, wherein said first and second print head carriage assemblies are independently operable in response to front and back page control signals provided by said control circuitry, and wherein said first and second print heads are independently operable so as to effectuate simultaneous printing on both sides of a piece of paper.

2. The printer in accordance with claim 1, wherein the first and second print heads are ink jet-type print heads.

3. The printer in accordance with claim 1, wherein the first and second print heads are bubble jet-type print heads.

4. The printer in accordance with claim 1, wherein said pair of pinch roller assemblies and said pair of tension roller assemblies each further comprises a plurality of friction surfaced rollers, the rollers of one half of each pair of assemblies in circumferential contact with the rollers of their respective opposite halves in counter-rotating fashion.

5. The printer in accordance with claim 4, wherein the rollers comprising the tension roller assemblies having a larger diameter than the rollers of the pinch roller assemblies.

6. The printer of claim 5, wherein the tension roller assemblies have diameters one-half percent larger than the diameters of the pinch roller assemblies.

7. A dot matrix ink jet-type desktop printer adapted to be connected to a personal computer over an RS232 serial connector, the improvement comprising:

(a) platen-less means for transporting paper, further comprising first and second tensioning means arranged in contacting, opposed, counter rotating fashion for securing a sheet of paper to be printed in a substantially rigid plane between the first and second tensioning means;

(b) a first print head carriage assembly disposed to one side of the plane of the paper, the first print head carriage assembly including a first print head;

(c) a second print head carriage assembly disposed in mirror-image fashion on the opposite side of the plane of the paper from the first print head carriage assembly, the second print head carriage assembly including a second print head;

(d) processor controlled electronic printer control circuitry including parallel pipelined data paths for providing front and back page printer information to said first and second print heads, wherein said first and second print head carriage assemblies are independently operable in response to front and back page control signals provided by said control circuitry, and wherein said first and second print heads are independently operable so as to effectuate simultaneous printing on both sides of a piece of paper.

8. The printer in accordance with claim 7, wherein the first and second print heads are ink jet-type print heads.

9. The printer in accordance with claim 7, wherein the first and second print heads are bubble jet-type print heads.

10. The printer in accordance with claim 7, the first tensioning means comprising a pair of pick-up pinch roller assemblies arranged in contacting, opposed, counter rotating fashion, the second tensioning means comprising a pair of tension roller assemblies arranged in contacting, opposed, counter rotating fashion and spaced-apart from the pinch roller assemblies, wherein a portion of a sheet of paper to be printed is disposed in a substantially rigid fashion in a plane defined between the first and second pairs of rollers.

11. The printer in accordance with claim 10, wherein said pair of pinch roller assemblies and said pair of tension roller assemblies each further comprises a plurality of friction surfaced rollers, the rollers of one half of each pair of assemblies in circumferential contact with the rollers of their respective opposite halves in counter-rotating fashion.

12. The printer in accordance with claim 11, wherein the rollers comprising the tension roller assemblies having a larger diameter than the rollers of the pinch roller assemblies.

13. The printer in accordance with claim 12, wherein the tension roller assemblies have diameters one-half percent larger than the diameters of the pinch roller assemblies.

14. The printer in accordance with claim 13, wherein both pairs of roller assemblies are rotated at the same angular speed of rotation, thereby tensioning a sheet of paper between the roller assemblies and supporting the paper in a substantially rigid orientation.

* * * * *